US011196197B1

(12) United States Patent
Wen

(10) Patent No.: US 11,196,197 B1
(45) Date of Patent: Dec. 7, 2021

(54) ELECTRICAL CONNECTOR

(71) Applicant: LOTES CO., LTD, Keelung (TW)

(72) Inventor: DaHe Wen, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 17/034,871

(22) Filed: Sep. 28, 2020

(30) Foreign Application Priority Data

Aug. 10, 2020 (CN) ..... 202021649174.8

(51) Int. Cl.
*H01R 12/71* (2011.01)
*H01R 13/24* (2006.01)

(52) U.S. Cl.
CPC ..... *H01R 12/716* (2013.01); *H01R 12/714* (2013.01); *H01R 13/2407* (2013.01)

(58) Field of Classification Search
CPC ..... H01R 12/716; H01R 13/2407; H01R 12/714; H01R 4/48; H01R 12/00; H05K 1/00
See application file for complete search history.

(56) References Cited

U.S. PATENT DOCUMENTS 4,260,212 A * 4/1981 Ritchie ..... H01R 4/2425 439/395
5,246,391 A * 9/1993 Seidler ..... H01R 12/57 439/693
7,988,501 B2 * 8/2011 Chang ..... H05K 7/1069 439/751
8,932,080 B2 * 1/2015 Chang ..... H01R 12/52 439/607.1
9,768,555 B2 * 9/2017 Farkas ..... H01R 13/646
10,128,593 B1 * 11/2018 Hejase ..... H01R 12/7076
10,199,756 B2 * 2/2019 Ju ..... H01R 13/2457
10,547,136 B2 * 1/2020 Ho ..... H01R 12/714
10,601,159 B2 * 3/2020 Wu ..... H01R 13/6474
2011/0151723 A1 * 6/2011 Liao ..... H01R 12/57 439/660
2012/0238137 A1 * 9/2012 Cai ..... H01R 12/7082 439/607.28

(Continued)

FOREIGN PATENT DOCUMENTS

CN 201994452 U 9/2011
CN 109273889 A 1/2019
CN 109687204 A 4/2019

*Primary Examiner* — Abdullah A Riyami
*Assistant Examiner* — Nelson R. Burgos-Guntin
(74) *Attorney, Agent, or Firm* — Locke Lord LLP; Tim Tingkang Xia, Esq.

(57) ABSTRACT

An electrical connector includes an insulating body having an accommodating slot vertically running therethrough, a terminal and an elastic body. The terminal has a base correspondingly accommodated in the accommodating slot. An elastic arm extends upward from the base. A contact portion extends from the elastic arm to be electrically connected to a first mating member. A bottom end of the terminal is used to be electrically connected to a second mating member. The elastic body is provided on the elastic arm. The elastic body is only in contact with the elastic arm. The elastic body includes an elastic insulating member and dielectric particles mixed with the elastic insulating member. A dielectric coefficient of the dielectric particles is greater than a dielectric coefficient of the electric insulating member.

18 Claims, 11 Drawing Sheets

(56) References Cited

U.S. PATENT DOCUMENTS

| | | | | |
|---|---|---|---|---|
| 2012/0252233 | A1* | 10/2012 | Sano | H01R 12/716 439/65 |
| 2016/0380396 | A1* | 12/2016 | Farkas | H01R 13/646 439/529 |
| 2018/0198219 | A1* | 7/2018 | Ju | H05K 7/1061 |
| 2018/0205161 | A1* | 7/2018 | Ju | H01R 4/024 |
| 2018/0375243 | A1* | 12/2018 | Hsu | H01R 12/707 |
| 2019/0190167 | A1* | 6/2019 | Choi | H01R 4/027 |
| 2019/0334272 | A1* | 10/2019 | Hsu | H01R 13/2435 |
| 2020/0303852 | A1* | 9/2020 | Wan | G06F 1/20 |

* cited by examiner

A-A

100

B-B

100

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN202021649174.8 filed in China on Aug. 10, 2020. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector used to connect a chip module and a circuit board.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing electrical connector is used to electrically connect a chip module and a circuit, and includes an insulating body and a plurality of terminals provided on the insulating body. The insulating body has an upper surface and a lower surface provided vertically opposite to each other, and a plurality of accommodating slots running vertically through the insulating body. Each accommodating slot correspondingly accommodates a terminal. The terminal includes a base accommodated in the corresponding accommodating slot, and an elastic arm formed by extending upward from the base. The elastic arm is provided with a contact portion to be electrically connected to the chip module. A conductive portion is formed by extending downward from the base, and the conductive portion is generally used to clamp a solder ball to be soldered to the circuit board.

In this electrical connector, the elastic arm extends upward out of the upper surface. In order to allow the elastic arm to have good elasticity, the elastic arm is designed to be longer. Further, a portion of the elastic arm in the accommodating slot may elastic deform. That is, the accommodating slot provides a reserved space for the deformation of the elastic arm. Thus, the elastic arm has a large area exposed in the air, and the base is mostly covered by the insulating body. Further, the elastic arm by itself is a thin and long structure, which has an excessive inductive reactance, such that the impedance of the elastic arm is higher, resulting in the electrical connector not conducive to transmission of high frequency signals. In addition, the elastic arms of the terminals in a back row and the elastic arms of the terminals in a front row may easily cause short-circuiting when being pressed by the chip module.

Therefore, a heretofore unaddressed need to design a novel electrical connector exists in the art to address the aforementioned deficiencies and inadequacies.

SUMMARY

The present invention is directed to an electrical connector, in which an elastic body is additionally provided on the elastic arm of the terminal, thus ensuring that the elastic arm has good elasticity, and changing the dielectric coefficient of its surrounding environment, such that the terminal has better high frequency characteristics.

To achieve the foregoing objective, the present invention adopts the following technical solutions.

An electrical connector is configured to electrically connect a first mating member and a second mating member. The electrical connector includes: an insulating body, having at least one accommodating slot vertically running through the insulating body; at least one terminal, the terminal having a base correspondingly accommodated in one of the at least one accommodating slot, an elastic arm extending upward from the base to be applied with a force and to elastically deform, and a contact portion formed by extending from the elastic arm and configured to be electrically connected to the first mating member, wherein a bottom end of the terminal is configured to be electrically connected to the second mating member; and at least one elastic body, provided on the elastic arm of the at least one terminal, wherein the elastic body is only in contact with the elastic arm, the elastic body comprises an elastic insulating member and dielectric particles mixed with the elastic insulating member, and a dielectric coefficient of the dielectric particles is greater than a dielectric coefficient of the elastic insulating member.

In certain embodiments, the dielectric particles are ceramic particles.

In certain embodiments, the elastic insulating member is formed by an elastic glue, and the dielectric particles are at least partially mixed in the elastic glue or at least partially directly attached to a surface of the elastic glue.

In certain embodiments, the elastic arm extends upward to pass beyond an upper surface of the insulating body, and the elastic body is at least partially located above the upper surface of the insulating body.

In certain embodiments, the elastic body extends partially into the accommodating slot, and a clearance exists between the elastic body and a wall of the accommodating slot.

In certain embodiments, the elastic body and a portion of the elastic arm covered by the elastic body have identical shapes and different sizes.

In certain embodiments, the elastic body is provided along an extending length of the whole elastic arm.

In certain embodiments, the electrical connector includes two elastic bodies, wherein the terminal has two elastic arms formed by extending upward and downward respectively from the base, each of the two elastic arms is provided with one of the two elastic bodies, a conductive portion is formed by extending from the elastic arm extending downward from the base, and the conductive portion is configured to be electrically connected to the second mating member.

In certain embodiments, the two elastic arms are provided to be vertically symmetrical.

In certain embodiments, the elastic arm comprises a first arm, a second arm and an extending arm connected between the first arm and the second arm, the first arm is formed by extending upward and backward from the base, the second arm is formed by extending upward and forward from the extending arm, the contact portion is formed by extending from the second arm, and the elastic body is at least provided on the second arm.

In certain embodiments, two retaining portions are respectively provided at a left side and a right side of the base, the two retaining portions are retained in the accommodating slot, and when the contact portion is pressed by the first mating member, the second arm and the elastic body thereon are both located between the two retaining portions, and clearances exist between the elastic body on the second arm and the retaining portions in a left-right direction.

In certain embodiments, the electrical connector includes a plurality of terminals, wherein the insulating body is provided with a plurality of accommodating slots correspondingly accommodating the terminals, the accommodating slots are provided in a plurality of rows in a front-rear direction, the contact portion of one of the terminals is located in front of the base of the same one of the terminals, and the elastic body on the elastic arm of each of the terminals in a back row is partially located right above the elastic body on the elastic arm of a corresponding one of the terminals in an adjacent front row.

In certain embodiments, the elastic arm has two branches and a through slot located between the two branches, the two branches converge together at an end close to the contact portion, the elastic body covers the two branches, and is provided with a through hole at a location corresponding to the through slot to be in communication with the through slot.

To achieve the foregoing objective, the present invention adopts the following technical solutions.

An electrical connector is configured to electrically connect a chip module and a circuit board. The electrical connector includes: an insulating body, having an upper surface and a lower surface provided vertically opposite to each other, and an accommodating slot vertically running through the insulating body; a terminal, having a base correspondingly accommodated in the accommodating slot, an elastic arm extending upward from the base to be applied with a force and to elastically deform, a contact portion formed by extending from the elastic arm and configured to be electrically connected to the chip module, and a conductive portion at a bottom end of the terminal configured to be electrically connected to the circuit board; and an elastic body, formed by an insulating material and provided on the elastic arm, and at least partially located above the upper surface, wherein the elastic body comprises an elastic insulating member, the elastic insulating member is mixed with dielectric particles, a dielectric coefficient of the dielectric particles is greater than a dielectric coefficient of the elastic insulating member, and the elastic body is only in contact with the elastic arm.

In certain embodiments, the dielectric particles are ceramic particles.

In certain embodiments, the insulating body has a supporting portion corresponding to a side of the accommodating slot and formed by extending upward from the upper surface to support the chip module, and when the chip module presses downward on the contact portion, the elastic body is limited by the supporting portion to prevent the elastic arm from excessively deviating.

In certain embodiments, the electrical connector includes two elastic bodies, wherein the terminal has two elastic arms formed by extending upward and downward respectively from the base, each of the two elastic arms is provided with one of the two elastic bodies, the conductive portion is formed by extending from the elastic arm extending downward from the base and is configured to be electrically connected to the circuit board.

In certain embodiments, a width of the elastic arm gradually reduces from the base toward the contact portion, the elastic arm is provided with a through slot, and a width of the through slot gradually increases from the base toward the contact portion, thus adjusting an inductive reactance of the elastic arm.

Compared with the related art, the electrical connector according to certain embodiments of the present invention has the following beneficial effects.

The elastic body is provided on the elastic arm. The elastic body includes the elastic insulating member, and the elastic insulating member is mixed with the dielectric particles having a higher dielectric coefficient, such that the elastic body has a higher dielectric coefficient and better elasticity, and simultaneously ensuring the elastic arm to have good elasticity. That is, the elastic body may deform based on the elastic deformation of the elastic arm, thus increasing the dielectric coefficient of the surrounding environment of the elastic arm, reducing the overall impedance of the terminal, and facilitating the terminal to stably transmit high frequency signals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
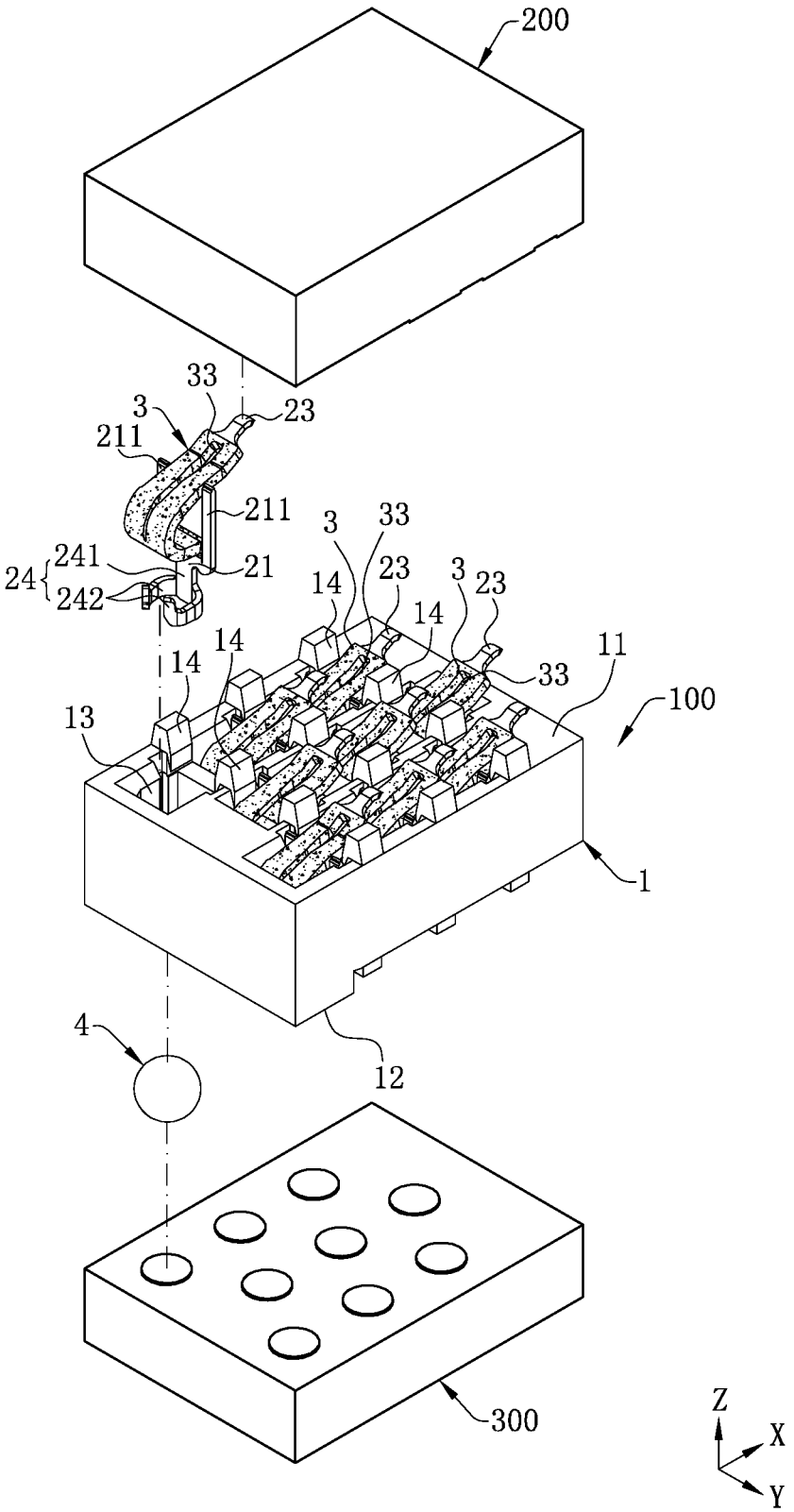
FIG. 1 is a perspective exploded view of an electrical connector, a chip module and a circuit board according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-11. In accordance with the purposes of this invention, as embodied and broadly described herein, this invention, in one aspect, relates to an electrical connector.

FIG. 1 shows an electrical connector 100 according to a first embodiment of the present invention. The electrical connector 100 is used to electrically connect a first mating member 200 and a second mating member 300. In this embodiment, the first mating member 200 is a chip module, and the second mating member 300 is a circuit board. In other embodiments, the first mating member 200 and the second mating member 300 may be other components. For convenience of description to the specific structures of the electrical connector 100, a front direction in a front-rear direction is defined as a positive direction of the X-axis, a right direction in a left-right direction is defined as a positive direction of the Y-axis, and an upward direction in a vertical direction is defined as a positive direction of the Z-axis. Any two directions of the front-rear direction, the left-right direction and the vertical direction are perpendicular to each other.

Figure 2:
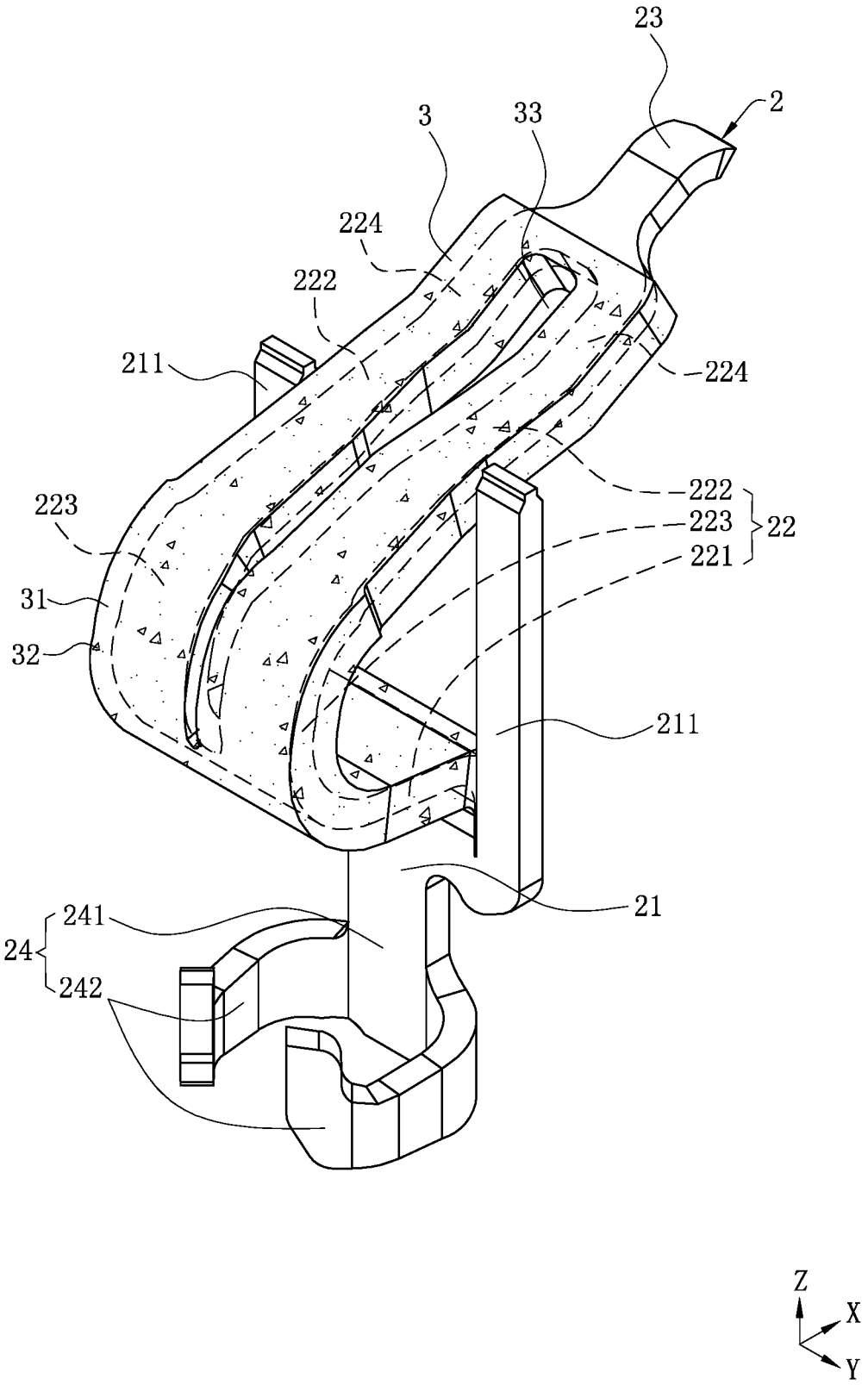
FIG. 2 is a perspective view of FIG. 1, where the terminal is provided with an elastic body.
Figure 3:
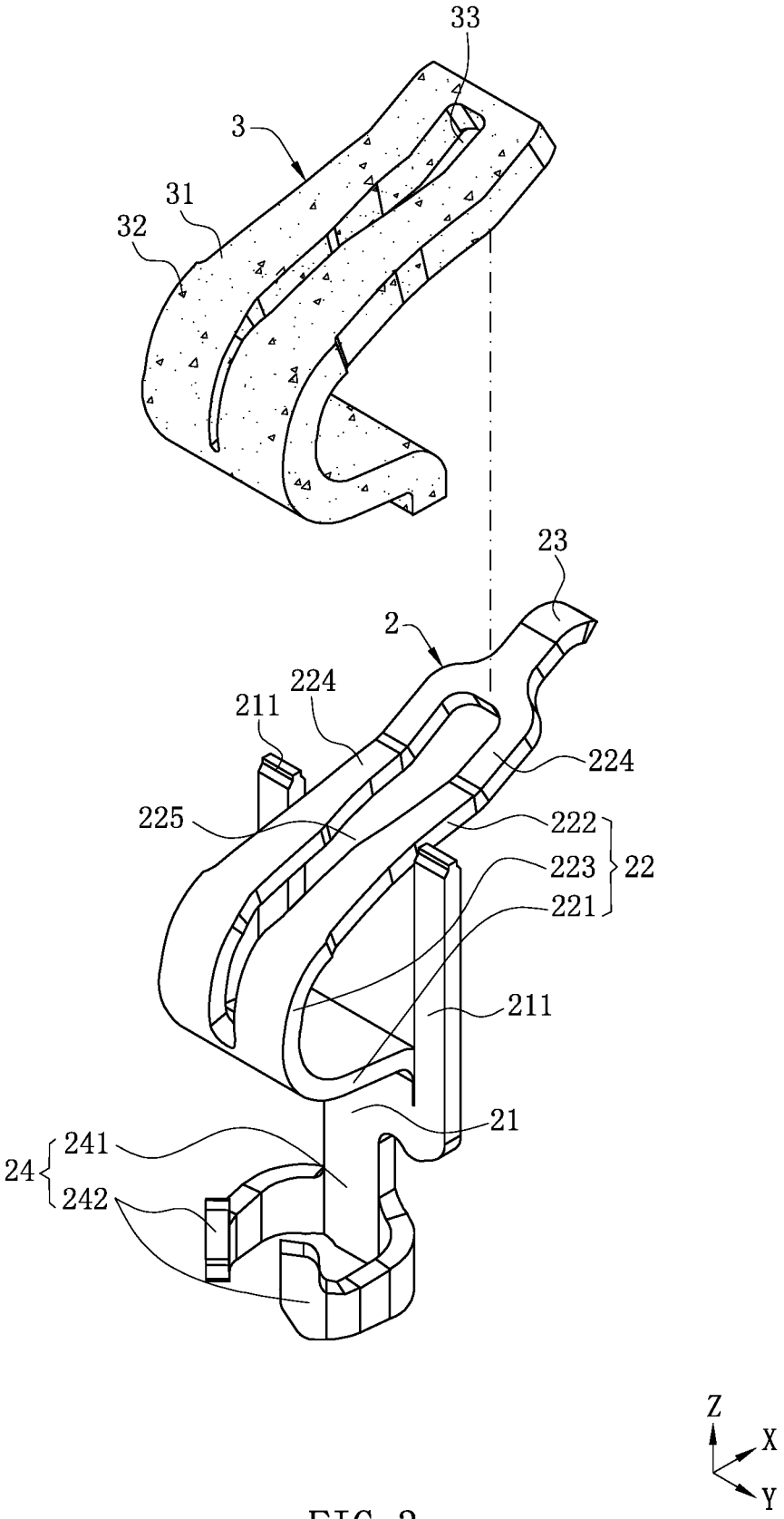
FIG. 3 is a perspective view of FIG. 2, where the terminal and the elastic body are separated.

As shown in FIG. 1, FIG. 2 and FIG. 3, the electrical connector 100 includes an insulating body 1, a plurality of terminals 2 provided on the insulating body 1, a plurality of elastic bodies 3 and a plurality of solder balls 4. In this embodiment, each terminal 2 correspondingly matches with an elastic body 3 and a solder ball 4. In other embodiments, the electrical connector 100 may be provided with one terminal 2 and one elastic body 3 corresponding to the terminal 2.

Figure 5:
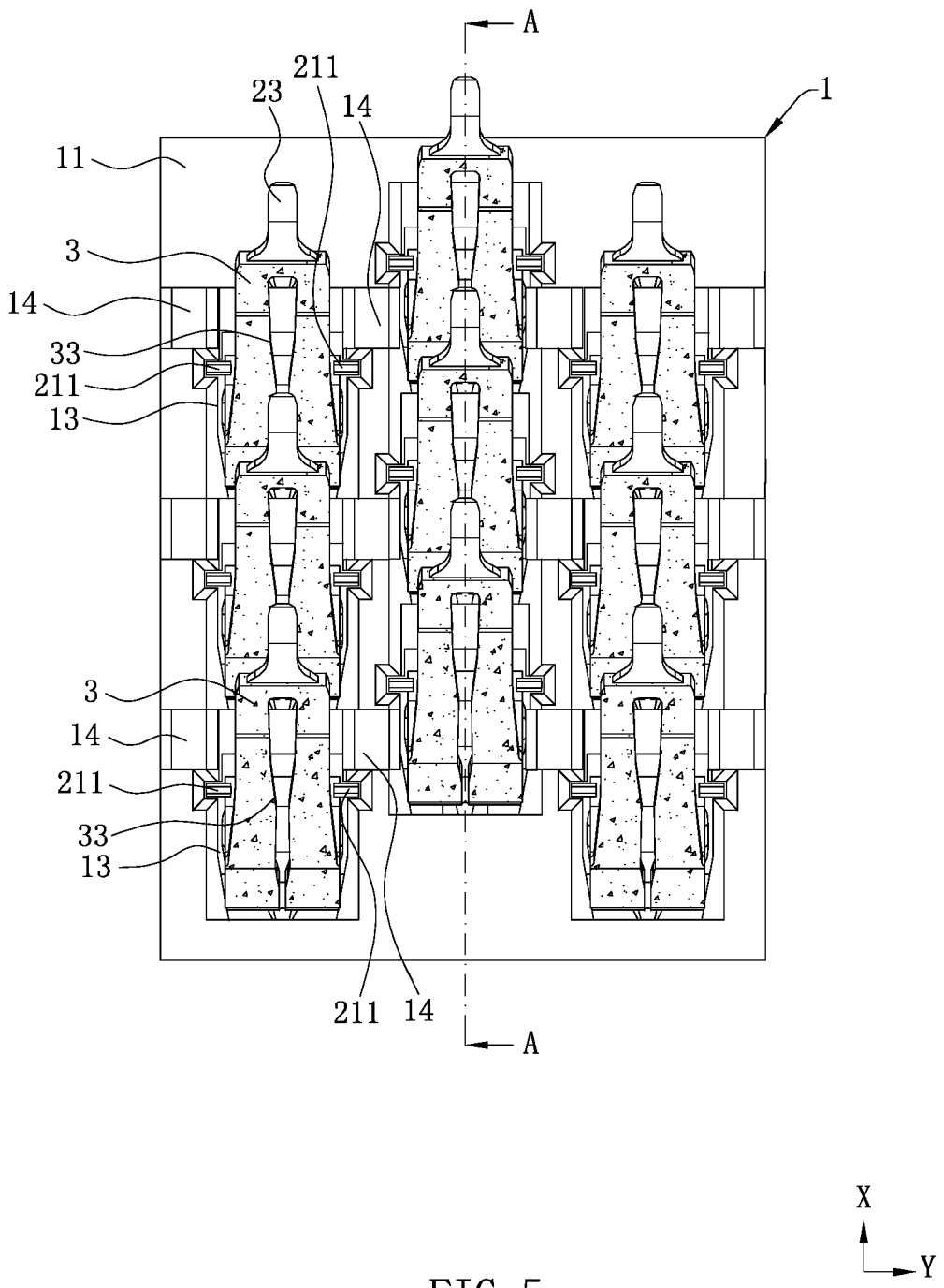
FIG. 5 is a top view of the electrical connector as shown in FIG. 1.
Figure 6:
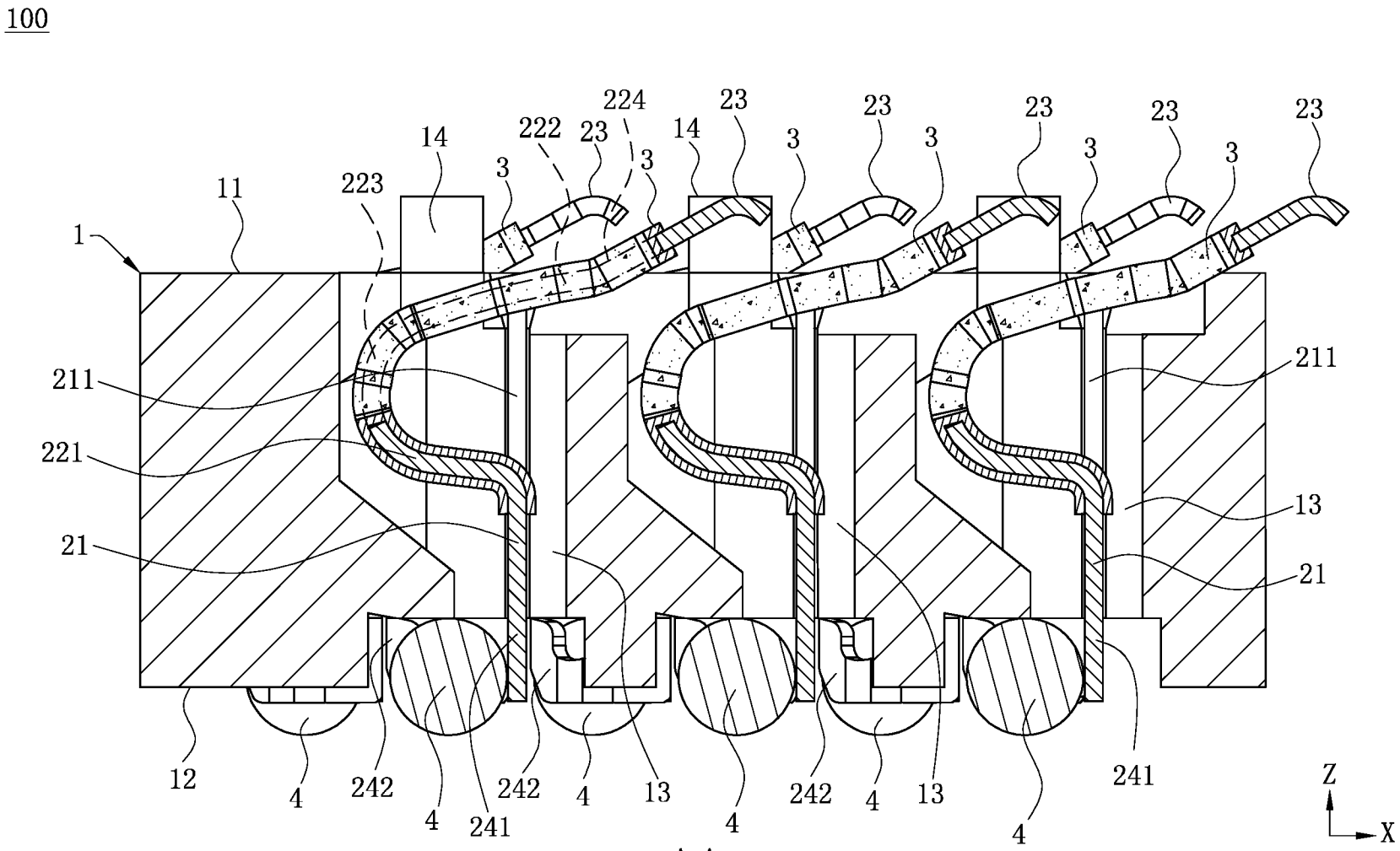
FIG. 6 is a sectional view of FIG. 5 along a line A-A.
Figure 7:
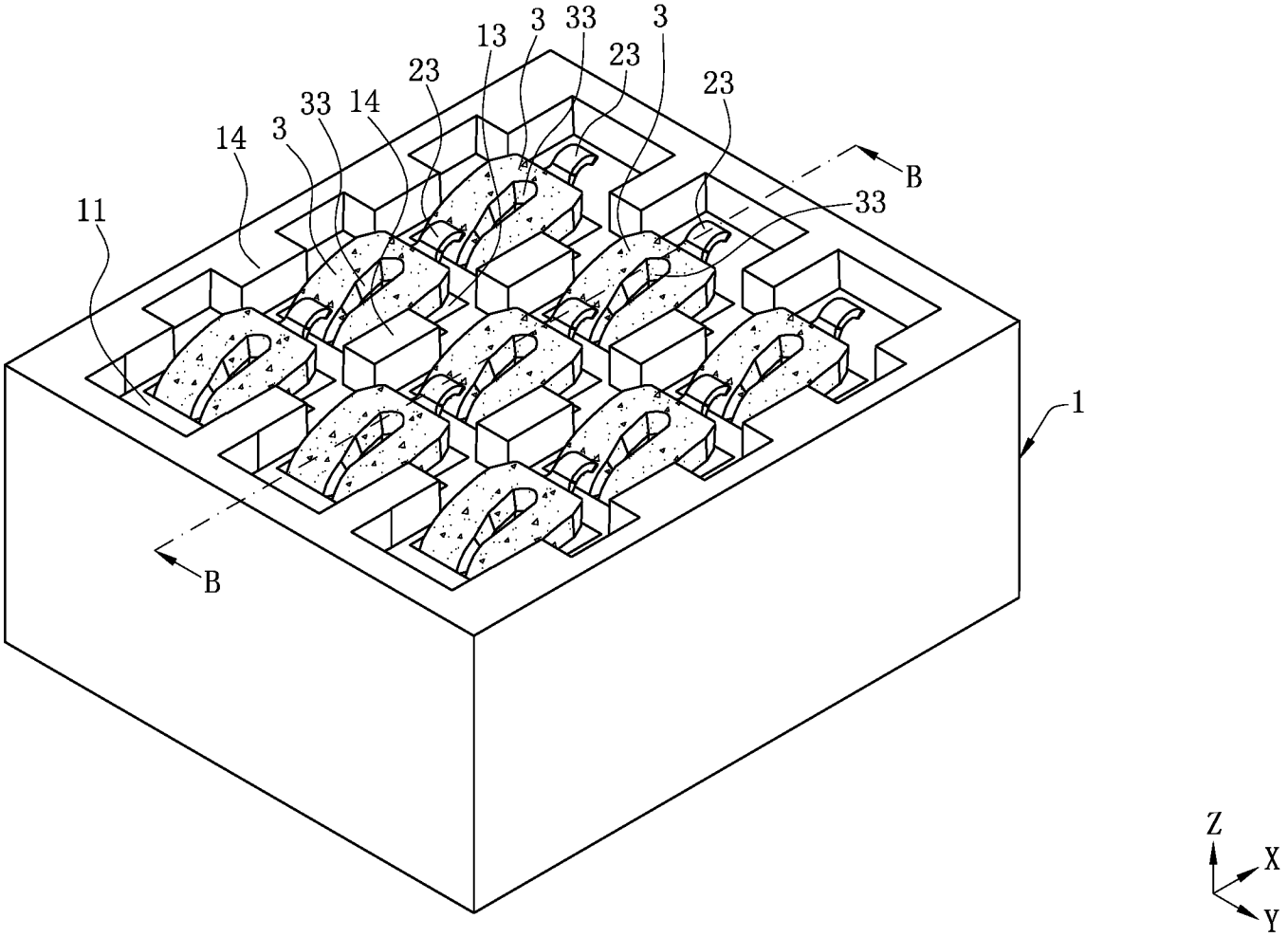
FIG. 7 is a perspective assembled view of an electrical connector according to a second embodiment of the present invention.

As shown in FIG. 1, FIG. 5 and FIG. 6, the insulating body 1 has an upper surface 11 and a lower surface 12 provided vertically opposite to each other, and a plurality of accommodating slots 13 running vertically through the insulating body 1. The accommodating slots 13 are provided in a plurality of rows in the front-rear direction, and the accommodating slots 13 in two adjacent rows in the front-rear direction are provided to be staggered. The insulating body 1 further has a plurality of supporting portions 14, each supporting portion 14 corresponding to a side of one accommodating slot 13 and formed by extending upward from the upper surface 11 to support the first mating component 200.

Figure 4:
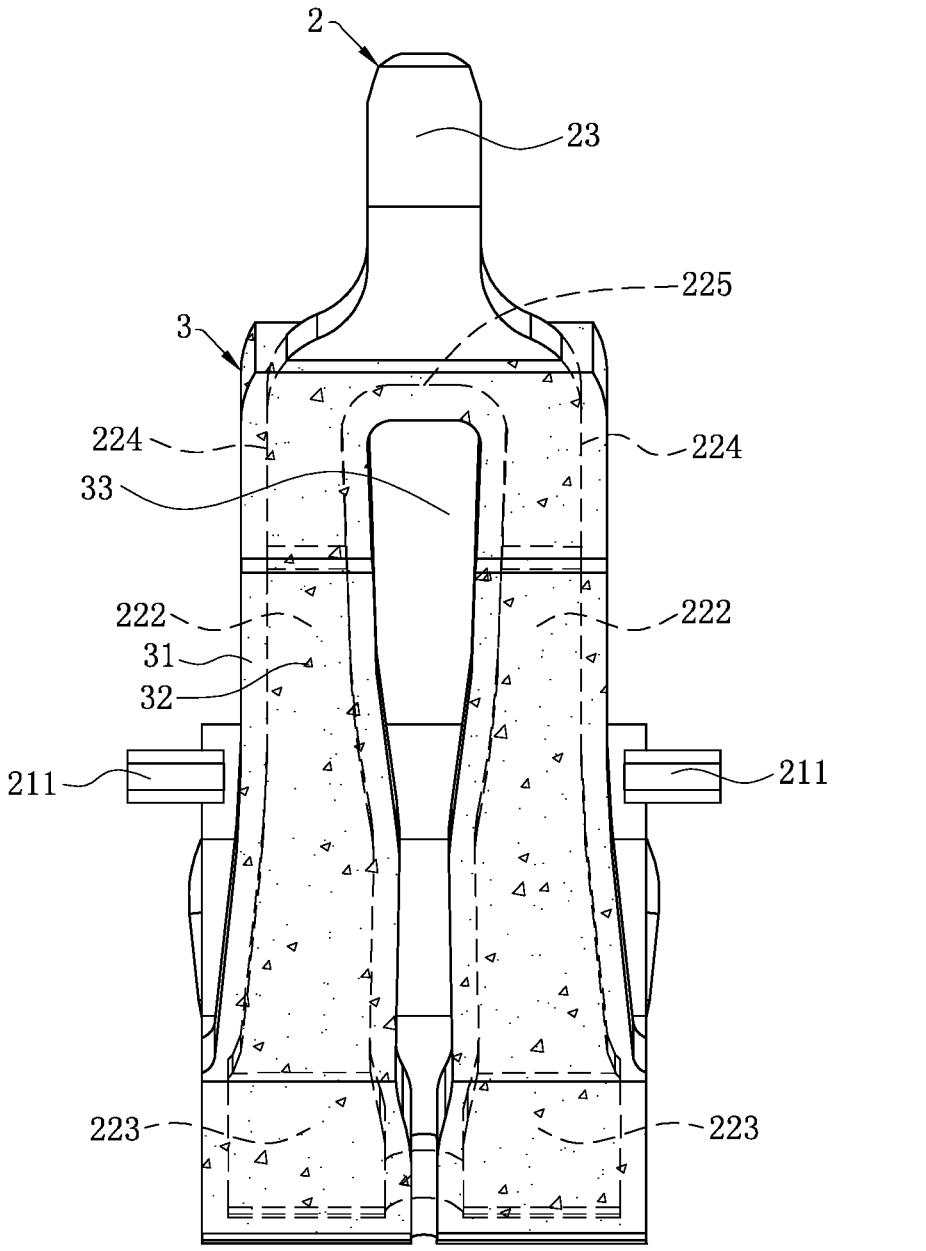
FIG. 4 is a top view of FIG. 2.
Figure 4:
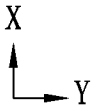

As shown in FIG. 4 and FIG. 5, the terminals 2 are one-to-one correspondingly accommodated in the accommodating slots 13. Each terminal 2 is formed by punching a metal plate.

As shown in FIG. 3, FIG. 4 and FIG. 6, each terminal 2 has a base 21, and the base 21 is accommodated in a corresponding accommodating slot 13. Two retaining portions 211 are provided respectively at a left side and a right side of the base 21, and the two retaining portions 211 are retained in the corresponding accommodating slot 13 to retain the terminal 2 onto the insulating body 1. A top end of each retaining portion 211 forms a strip connecting portion (not labeled) to be connected to a strip (not shown).

As shown in FIG. 3, FIG. 4 and FIG. 6, an elastic arm 22 is formed by extending upward from the base 21. The elastic arm 22 extends upward to pass beyond the upper surface 11 of the insulating body 1, and the elastic arm 22 is applied with a force and elastically deforms. A contact portion 23 is formed by extending from the elastic arm 22 to be electrically connected to the first mating component 200. The elastic arm 22 includes a first arm 221, a second arm 222 and an extending arm 223 connected between the first arm 221 and the second arm 222. The extending arm 223 is a transitional section between the first arm 221 and the second arm 222. Viewing from the left-right direction, the extending arm 223 is in a curved shape. The first arm 221 is formed by extending upward and backward from the base 21, and the second arm 222 is formed by extending upward and forward from the extending arm 223. A width of the second arm 222 gradually reduces from the extending arm 223 toward the contact portion 23. The contact portion 23 is formed by extending from the second arm 222, and the contact portion 23 is located in front of the base 21.

As shown in FIG. 2, FIG. 3 and FIG. 4, the elastic arm 22 has two branches 224 provided separately in the left-right direction, and a through slot 225 located between the two branches 224. In this embodiment, the two branches 224 are respectively provided to be separate from the extending arm 223, and converge together at an end close to the contact portion 23, such that the through slot 225 extends on the extending arm 223 and the second arm 222. A width of the through slot 225 on the extending arm 223 is less than the width of the through slot 225 on the second arm 222, and the width of the through slot 225 on the second arm 222 gradually increases toward the contact portion 23. With this design, the width of the through slot 225 may be designed based on the width of the elastic arm 22, thus adjusting the inductive reactance of the elastic arm 22.

As shown in FIG. 3 and FIG. 6, each terminal 2 has a conductive portion 24 formed by extending downward from the base 21. The conductive portion 24 is located at a bottom end of the terminal 2 to be electrically connected to the second mating member 300. The conductive portion 24 includes a connecting arm 241 formed by extending downward from a bottom end of the base 21, and two clamping arms 242 formed by respectively extending backward from a left side and a right side of the connecting arm 241. The two clamping arms 242 are used to clamp a solder ball 4.

As shown in FIG. 3, each elastic body 3 is formed by an insulating material, and each elastic body 3 includes an elastic insulating member 31 and dielectric particles 32 mixed with the elastic insulating member 31. A dielectric coefficient of the dielectric particles 32 is greater than a dielectric coefficient of the elastic insulating member 31. The dielectric particles 32 are at least partially mixed in the elastic insulating member 31 or at least partially directly attached to a surface of the elastic insulating member 31. In this embodiment, the elastic insulating member 31 is formed by an elastic glue, the dielectric particles 32 are ceramic particles, and the elastic insulating member 31 provides the function to fix the dielectric particles 32, which is not limited thereto in other embodiments.

As shown in FIG. 2, FIG. 3 and FIG. 4, each elastic body 3 is provided along an extending length of the whole elastic arm 22. That is, the elastic body 3 covers the first arm 221, the extending arm 223 and the second arm 222, and is provided with a through hole 31 at a location corresponding to the through slot 225 to be in communication with the through slot 225. The elastic body 3 and a portion of the elastic arm 22 covered by the elastic body 3 have identical shapes and different sizes. The elastic body 3 is only in contact with the elastic arm 22, without being in contact with any other component. That is, a majority portion or all of the outer surface of the elastic body 3 is exposed in air, thus increasing the dielectric coefficient of the surrounding environment of the elastic arm 22, reducing the impedance of the elastic arm 22, and facilitating the stable transmission of the high frequency signals.

As shown in FIG. 4, FIG. 5 and FIG. 6, the elastic arm 22 is at least partially located above the upper surface 11 of the insulating body 1, and the corresponding supporting portion 14 is located at a side corresponding to the elastic arm 22. In this embodiment, the elastic body 3 partially extends into the accommodating slot 13, and a clearances exists between the elastic body 3 and a wall of the accommodating slot 13, thus providing a reserved space for the elastic arm 22 when being applied with the force and elastically deforming. When the first mating member 200 presses downward on the contact portion 23, the elastic body 3 is limited by the supporting portion 14 in the left-right direction, preventing the elastic arm 22 from excessively deviating. Further, the elastic body 3 has elasticity, thus reducing the friction with the supporting portion 14.

As shown in FIG. 2, FIG. 4 and FIG. 6, when the contact portion 23 is pressed by the first mating member 200, the second arm 222 and the elastic body 3 thereon are both located between the two retaining portions 211, and clearances exist between the elastic body 3 on the second arm 222 and the retaining portions 211 in the left-right direction, such that when the contact portion 23 of the terminal 2 is in contact with the first mating member 200, the retaining portions 211 may be stably fixed in the accommodating slot 13, and the elastic body 3 on the second arm 222 does not easily generate a significant friction with the retaining portions 211, thus facilitating the elastic deformation of the elastic arm 22.

As shown in FIG. 5 and FIG. 6, the elastic body 3 on the elastic arm 22 of each of the terminals 2 in a back row is partially located right above the elastic body 3 on the elastic arm 22 of a corresponding terminal 2 in a front row, such that the electrical connector 100 may be installed with more terminals 2 in the limited space, and preventing the adjacent terminals 2 from short-circuiting after the elastic arm 22 is pressed.

Figure 8:
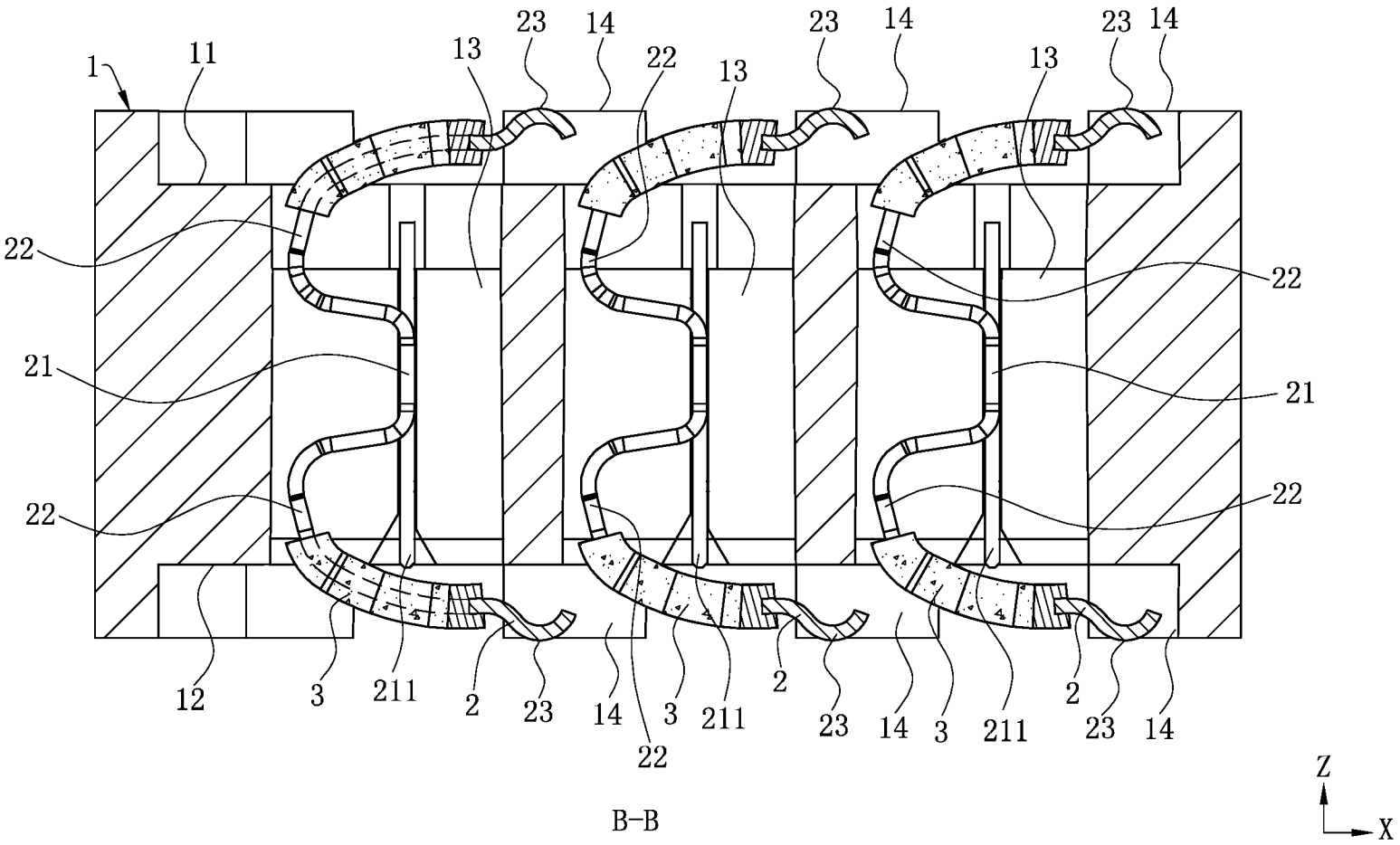
FIG. 8 is a sectional view of FIG. 7 along a line B-B.
Figure 9:
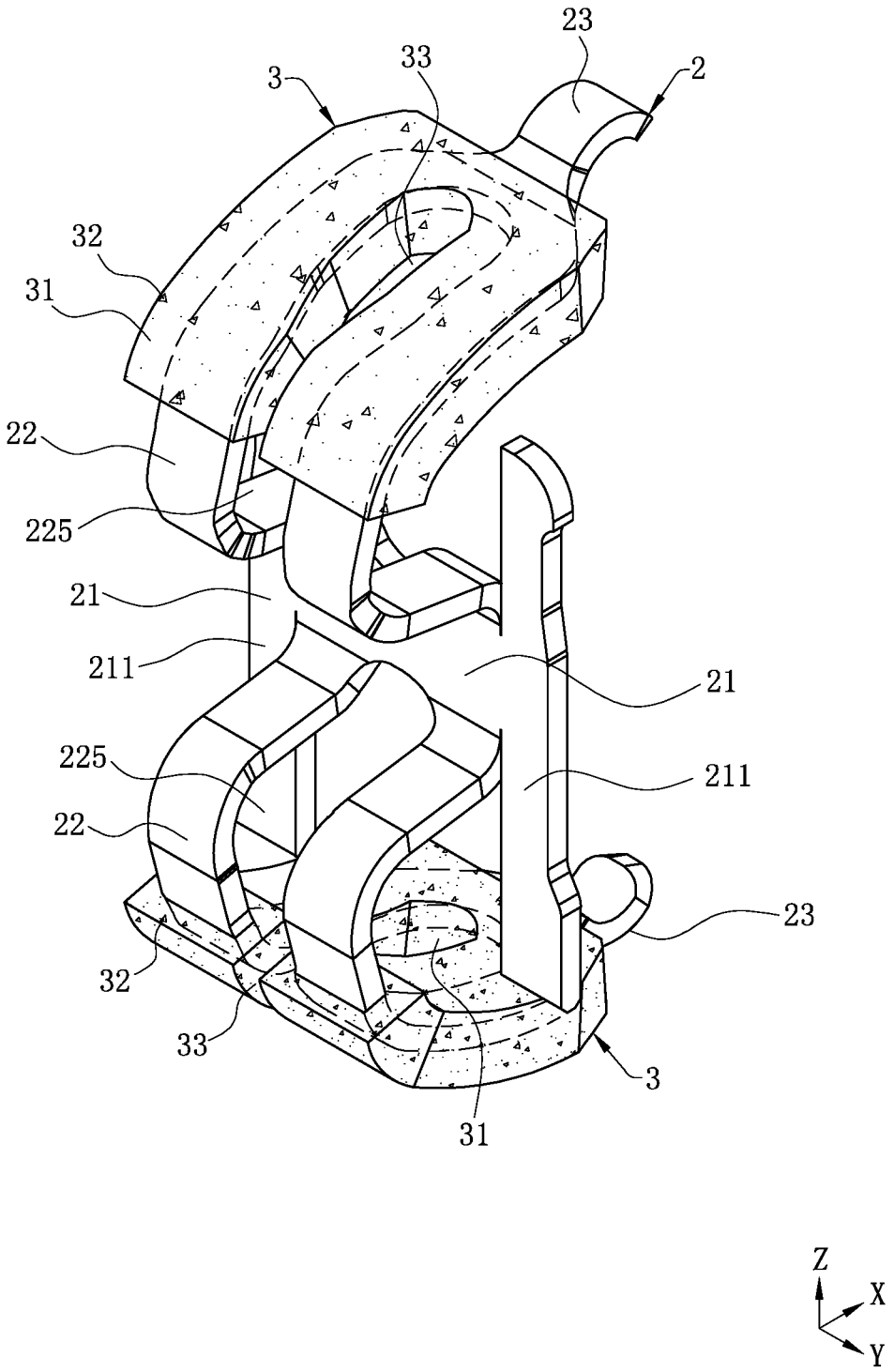
FIG. 9 is a perspective view of FIG. 7, where the terminal is provided with an elastic body.
Figure 10:
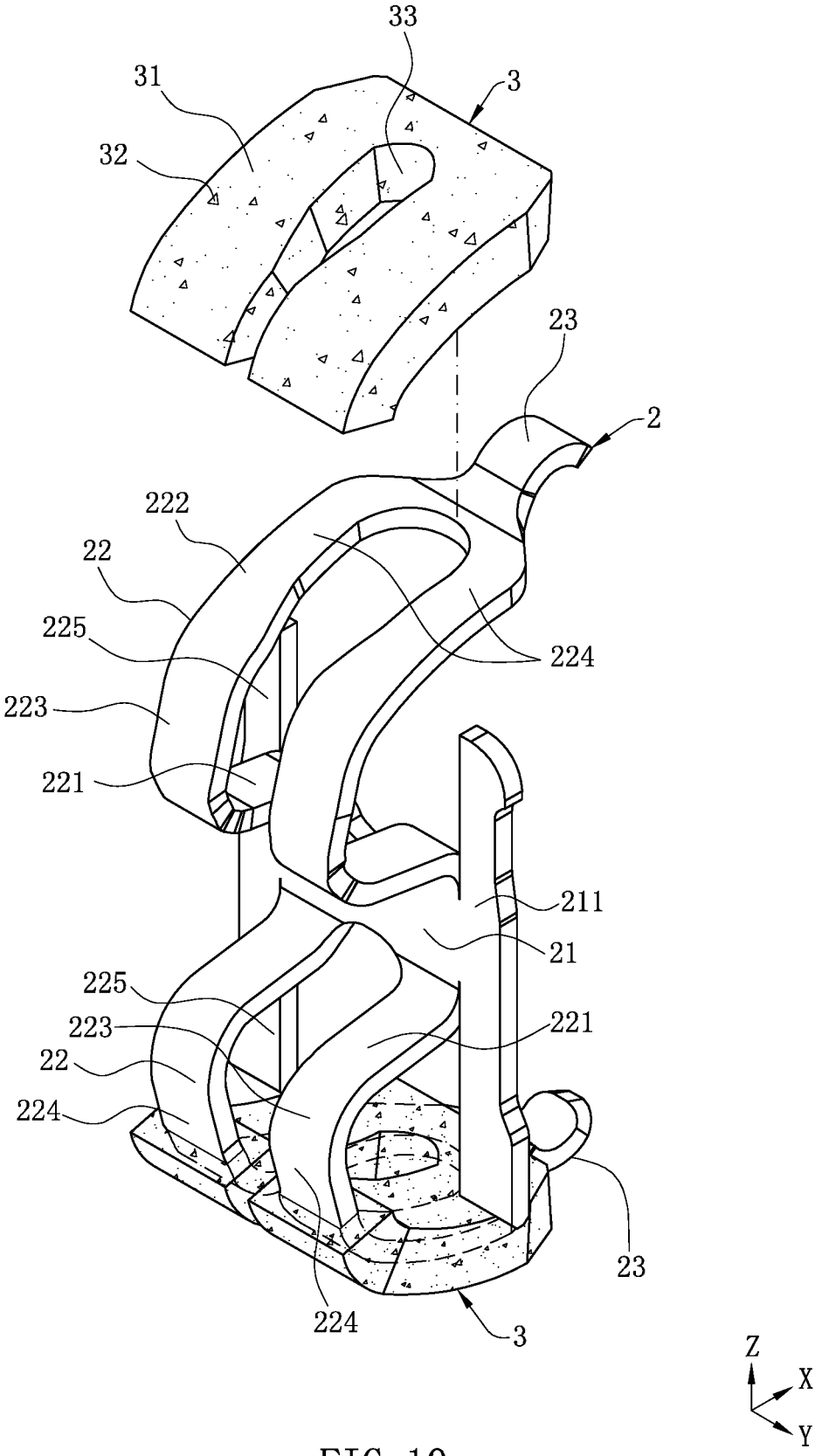
FIG. 10 is a perspective view of FIG. 9, where the terminal and the elastic body are separated.
Figure 11:
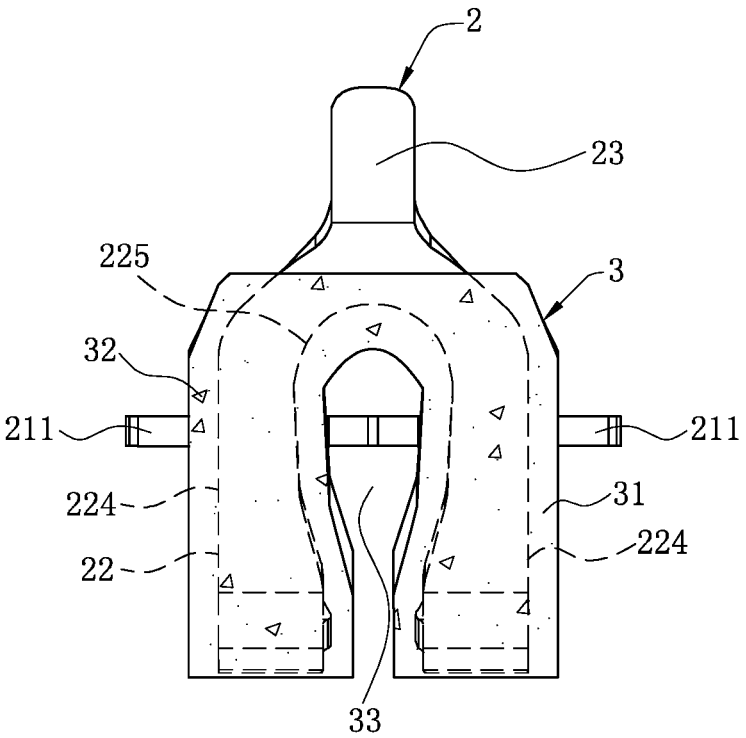
FIG. 11 is a top view of FIG. 9.
Figure 11:
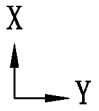

FIG. 8, FIG. 9 and FIG. 10 show an electrical connector 100 according to a second embodiment of the present invention, which is different from the first embodiment in that: the insulating body 1 is formed with a plurality of supporting portions 14 respectively extending from the upper surface 11 and the lower surface 12, and the supporting portions 14 formed by extending downward are used to abut the second mating member 300. Two elastic arms 22 are formed by respectively extending upward and downward from the base 21, and the two elastic arms 22 are provided to be vertically symmetrical. The bottom ends of the retaining portions 211 extend to form the strip connecting portion (not shown). Each elastic arm 22 is provided with a corresponding elastic body 3, and the elastic body 3 is only provided on the second arm 222. A conductive portion 24 is formed by extending from the elastic arm 22 extending downward from the base 21. The conductive portion 24 is in a curved shape, and is used to be electrically connected to the second mating member 300.

In sum, the electrical connector 100 according to certain embodiments of the present invention has the following beneficial effects:

(1) The elastic body 3 is provided on the elastic arm 22. The elastic body 3 includes the elastic insulating member 31, and the elastic insulating member 31 is mixed with the dielectric particles 32 having a higher dielectric coefficient, such that the elastic body 3 has a higher dielectric coefficient and better elasticity, and simultaneously ensuring the elastic arm 22 to have good elasticity. That is, the elastic body 3 may deform based on the elastic deformation of the elastic arm 22, thus increasing the dielectric coefficient of the surrounding environment of the elastic arm 22, reducing the overall impedance of the terminal 2, and facilitating the terminal 2 to stably transmit high frequency signals.

(2) The elastic arm 22 is provided with the two branches 224 separated in the left-right direction and the through slot 225 located between the two branches 224. A width of the through slot 225 on the extending arm 223 is less than the width of the through slot 225 on the second arm 222, and the width of the through slot 225 on the second arm 222 gradually increases toward the contact portion 23, such that a distance between the two branches 224 increases. With this design, the width of the through slot 225 may be designed based on the width of the elastic arm 22, thus adjusting the inductive reactance of the elastic arm 22.

(3) The elastic body 3 partially extends into the accommodating slot 13, and a clearance exists between the elastic body 3 and a wall of the accommodating slot 13, thus providing a reserved space for the elastic arm 22 when being applied with the force and elastically deforming. When the first mating member 200 presses downward on the contact portion 23, the elastic body 3 is limited by the supporting portion 14 in the left-right direction, preventing the elastic arm 22 from excessively deviating. Further, the elastic body 3 has elasticity, thus reducing the friction with the supporting portion 14.

(4) Clearances exist between both the second arm 222 as well as the elastic body 3 on the second arm 222 and the retaining portions 211, such that when the terminal 2 is in contact with the first mating member 200, the retaining portions 211 may be stably fixed in the accommodating slot 13, and the elastic body 3 on the second arm 222 does not easily generate a significant friction with the retaining portions 211, thus facilitating the elastic deformation of the elastic arm 22.

(5) The elastic body 3 on the elastic arm 22 of each of the terminals 2 in a back row is partially located right above the elastic body 3 on the elastic arm 22 of a corresponding terminal 2 in a front row, such that the electrical connector 100 may be installed with more terminals 2 in the limited space, and preventing the adjacent terminals 2 from short-circuiting after the elastic arm 22 is pressed.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connect a first mating member and a second mating member, the electrical connector comprising:

an insulating body, having at least one accommodating slot vertically running through the insulating body;

at least one terminal, the terminal having a base correspondingly accommodated in one of the at least one accommodating slot, an elastic arm extending upward from the base to be applied with a force and to elastically deform, and a contact portion formed by extending from the elastic arm and configured to be electrically connected to the first mating member, wherein a bottom end of the terminal is configured to be electrically connected to the second mating member; and at least one elastic body, provided on the elastic arm of the at least one terminal, wherein the elastic body is only in contact with the elastic arm, the elastic body comprises an elastic insulating member and dielectric particles mixed with the elastic insulating member, and a dielectric coefficient of the dielectric particles is greater than a dielectric coefficient of the elastic insulating member.

2. The electrical connector according to claim 1, wherein the dielectric particles are ceramic particles.

3. The electrical connector according to claim 1, wherein the elastic insulating member is formed by an elastic glue, and the dielectric particles are at least partially mixed in the elastic glue or at least partially directly attached to a surface of the elastic glue.

4. The electrical connector according to claim 1, wherein the elastic arm extends upward to pass beyond an upper surface of the insulating body, and the elastic body is at least partially located above the upper surface of the insulating body.

5. The electrical connector according to claim 4, wherein the elastic body extends partially into the accommodating slot, and a clearance exists between the elastic body and a wall of the accommodating slot.

6. The electrical connector according to claim 1, wherein the elastic body and a portion of the elastic arm covered by the elastic body have identical shapes and different sizes.

7. The electrical connector according to claim 1, wherein the elastic body is provided along an extending length of the whole elastic arm.

8. The electrical connector according to claim 1, comprising two elastic bodies, wherein the terminal has two elastic arms formed by extending upward and downward respectively from the base, each of the two elastic arms is provided with one of the two elastic bodies, a conductive portion is formed by extending from the elastic arm extending downward from the base, and the conductive portion is configured to be electrically connected to the second mating member.

9. The electrical connector according to claim 8, wherein the two elastic arms are provided to be vertically symmetrical.

10. The electrical connector according to claim 1, wherein the elastic arm comprises a first arm, a second arm and an extending arm connected between the first arm and the second arm, the first arm is formed by extending upward and backward from the base, the second arm is formed by extending upward and forward from the extending arm, the contact portion is formed by extending from the second arm, and the elastic body is at least provided on the second arm.

11. The electrical connector according to claim 10, wherein two retaining portions are respectively provided at a left side and a right side of the base, the two retaining portions are retained in the accommodating slot, and when the contact portion is pressed by the first mating member, the second arm and the elastic body thereon are both located between the two retaining portions, and clearances exist between the elastic body on the second arm and the retaining portions in a left-right direction.

12. The electrical connector according to claim 1, comprising a plurality of terminals, wherein the insulating body is provided with a plurality of accommodating slots correspondingly accommodating the terminals, the accommodating slots are provided in a plurality of rows in a front-rear direction, the contact portion of one of the terminals is located in front of the base of the same one of the terminals, and the elastic body on the elastic arm of each of the terminals in a back row is partially located right above the elastic body on the elastic arm of a corresponding one of the terminals in an adjacent front row.

13. The electrical connector according to claim 1, wherein the elastic arm has two branches and a through slot located between the two branches, the two branches converge together at an end close to the contact portion, the elastic body covers the two branches, and is provided with a through hole at a location corresponding to the through slot to be in communication with the through slot.

14. An electrical connector, configured to electrically connect a chip module and a circuit board, the electrical connector comprising:

an insulating body, having an upper surface and a lower surface provided vertically opposite to each other, and an accommodating slot vertically running through the insulating body;

a terminal, having a base correspondingly accommodated in the accommodating slot, an elastic arm extending upward from the base to be applied with a force and to elastically deform, a contact portion formed by extending from the elastic arm and configured to be electrically connected to the chip module, and a conductive portion at a bottom end of the terminal configured to be electrically connected to the circuit board; and an elastic body, formed by an insulating material and provided on the elastic arm, and at least partially located above the upper surface, wherein the elastic body comprises an elastic insulating member, the elastic insulating member is mixed with dielectric particles, a dielectric coefficient of the dielectric particles is greater than a dielectric coefficient of the elastic insulating member, and an outer surface of the elastic body is only in contact with the elastic arm.

15. The electrical connector according to claim 14, wherein the dielectric particles are ceramic particles.

16. The electrical connector according to claim 14, wherein the insulating body has a supporting portion corresponding to a side of the accommodating slot and formed by extending upward from the upper surface to support the chip module, and when the chip module presses downward on the contact portion, the elastic body is limited by the supporting portion to prevent the elastic arm from excessively deviating.

17. The electrical connector according to claim 14, comprising two elastic bodies, wherein the terminal has two elastic arms formed by extending upward and downward respectively from the base, each of the two elastic arms is provided with one of the two elastic bodies, the conductive portion is formed by extending from the elastic arm extending downward from the base and is configured to be electrically connected to the circuit board.

18. The electrical connector according to claim 14, wherein a width of the elastic arm gradually reduces from the base toward the contact portion, the elastic arm is provided with a through slot, and a width of the through slot gradually increases from the base toward the contact portion, thus adjusting an inductive reactance of the elastic arm.

* * * * *